US006328425B1

(12) United States Patent
Silverbrook

(10) Patent No.: US 6,328,425 B1
(45) Date of Patent: Dec. 11, 2001

(54) THERMAL BEND ACTUATOR FOR A MICRO ELECTRO-MECHANICAL DEVICE

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 09/575,126

(22) Filed: May 23, 2000

(30) Foreign Application Priority Data

Jun. 30, 1999 (AU) ..... 99/1307

(51) Int. Cl.[7] ..... B41J 2/04; B41J 2/135
(52) U.S. Cl. ..... 347/54; 347/44
(58) Field of Search ..... 347/20, 44, 47, 347/54, 65, 67; 251/129.01, 30.01, 30.03, 84, 295; 60/528, 529; 310/307, 330, 331, 343

(56) References Cited

FOREIGN PATENT DOCUMENTS 412 221 A2 2/1991 (EP) ..... G11B/21/02
848 265 A2 6/1998 (EP) ..... G02B/1/00

*Primary Examiner*—John Barlow
*Assistant Examiner*—Juanita Stephens

(57) ABSTRACT

A micro electro-mechanical device embodied within an ink ejection nozzle having an actuating arm that is caused to move an ink displacing paddle when heat inducing electric current is passed through the actuating arm is disclosed. The paddle is located in an ink chamber and the actuating arm passes through an actuator aperture in the chamber. The actuating arm has an inner arm and an outer arm and electrical current is supplied to the inner arm to cause bending of the actuating arm so as to move the paddle to eject a droplet of ink from the ink chamber. To prevent spurious bending modes and to force the actuating arm to undergo a desired bending mode so that the paddle moves appropriately to eject the ink droplet, the actuating arm includes connecting rods which connect side edges of the inner and outer arms and torsion bars which connect the connecting rods. The torsion bars and connecting rods reduce the likelihood of unwanted bending modes taking place which may effect the expulsion of an ink droplet from the chamber.

18 Claims, 4 Drawing Sheets

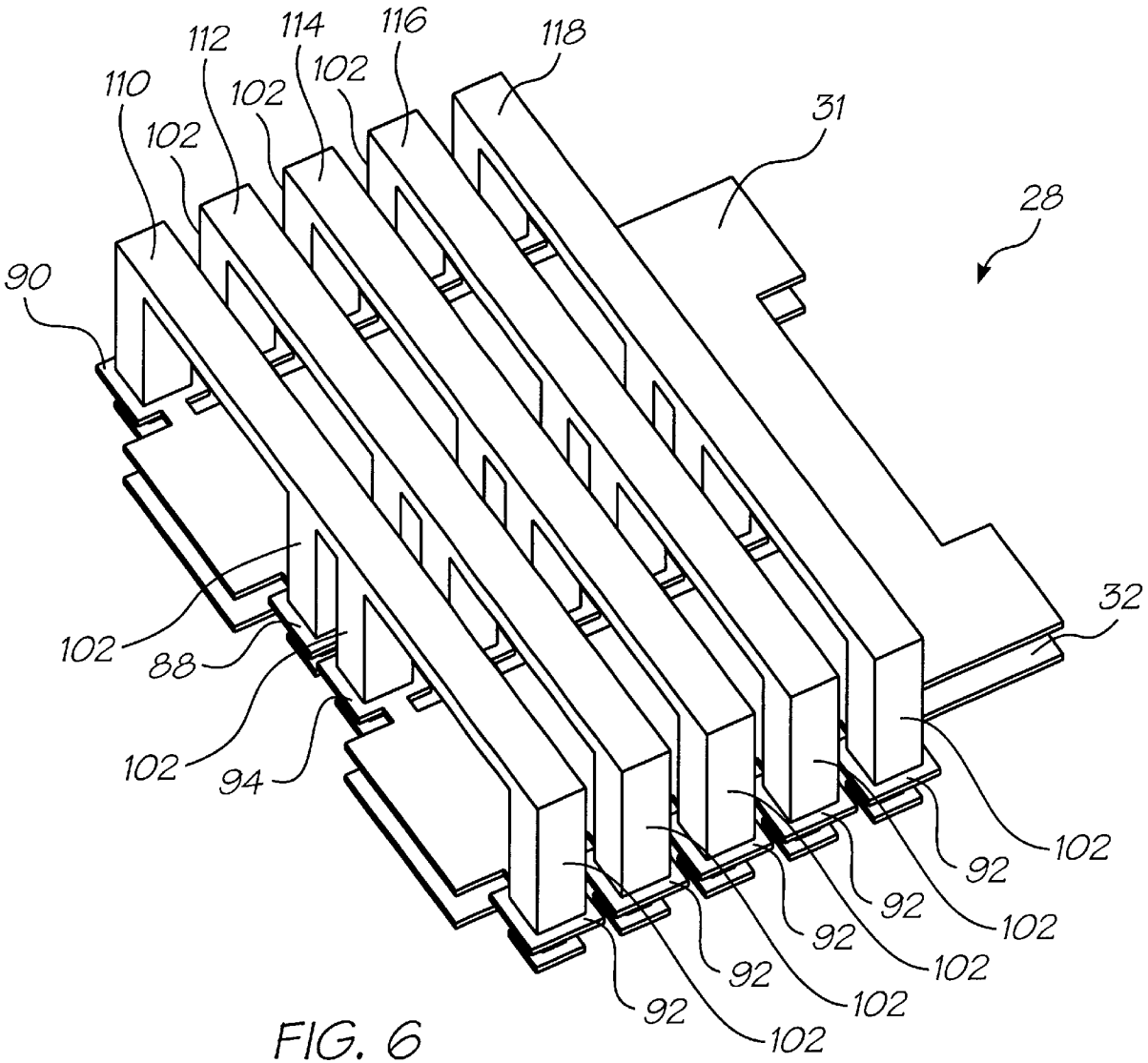
28
31
118
116
114
112
110
90
102
102
102

THERMAL BEND ACTUATOR FOR A MICRO ELECTRO-MECHANICAL DEVICE

FIELD OF THE INVENTION

This invention relates to a thermal bend actuator for a micro electro-mechanical (MEM) device. The invention has application in ejection nozzles of the type that are fabricated by integrating the technologies applicable to micro electro-mechanical systems (MEMS) and complimentary metal-oxide semiconductor ("CMOS") integrated circuits, and the invention is hereinafter described in the context of that application. However, it will be understood that the invention does have broader application, to thermal bend actuators within other types of MEM devices.

CO-PENDING APPLICATIONS

Various methods, systems and apparatus relating to the present invention are disclosed in the following co-pending applications filed by the applicant or assignee of the present invention simultaneously with the present application:

NPA001US, NPA002US, NPA003US, NPA004US, NPA005US, NPA006US, NPA007US, NPA008US, NPA009US, NPA010US, NPA012US, NPA016US, NPA017US, NPA018US, NPA019US, NPA020US, NPA021US, NPA030US, NPA035US, NPA048US, NPA050US, NPA051US, NPA052US, NPA075US, NPB001US, NPB002US, NPK002US, NPK003US, NPK004US, NPK005US, NPK007US, NPM001US, NPM002US, NPM003US, NPM004US, NPN001US, NPN002US, NPN003US, NPP001US, NPP002US, NPP003US, NPP005US, NPP006US, NPP007US, NPP008US, NPP016US, NPP017US, NPP018US, NPP019US, NPS001US, NPS003US, NPS020US, NPT001US, NPT002US, NPT003US, NPT004US, NPX001US, NPX003US, NPX008US, NPX011US, NPX014US, NPX016US, NPX020US, NPX022US, IJ52US, IJM52US, MJ10US, MJ11US, MJ12US, MJ13US, MJ14US, MJ15US, MJ34US, MJ47US, MJ52US, MJ58US, MJ62US, MJ63US, MJ64US, MJ65US, MJ66US, PAK04US, PAK05US, PAK06US, PAK07US, PAK08US, PEC01US, PEC02US, PP01US, PP02US, PP03US, PP04US, PP07US, PP08US, PP09US, PP10US, PP11US, PP12US, PP13US, PP14US, PP15US, PP16US, PP17US.

The disclosures of these co-pending applications are incorporated herein by cross-reference. Each application is temporarily identified by its docket number. This will be replaced by the corresponding USSN when available.

BACKGROUND OF THE INVENTION

A high speed page width ink jet printer has recently been developed by the present applicant. This typically employs in the order of 51, 200 ink jet nozzles to print on A4 size paper to provide photographic quality image printing at 1,600 dpi. In order to achieve this nozzle density, the nozzles are fabricated by integrating MEMS-CMOS technology and in this context reference may be made to International Patent Application No.PCT/AU00/00338 lodged by the present Applicant and entitled "Thermal Actuator".

These high speed page width ink jet printers produce an image on a sheet by causing a thermal bend actuator arm to move relative to a substrate by forming the actuating arm in part from an electrically resistive material and by applying a current to the arm to effect movement of the arm. The arm is connected to a paddle so that upon movement of the arm the paddle is moved to eject a droplet of ink onto the sheet. In order to eject the droplet of ink the paddle extends into a nozzle chamber which has a nozzle aperture, and movement of the paddle causes the droplet to be ejected from the nozzle aperture. The actuating arm is fixed at one end and when current is applied to the arm the arm is caused to bend to, in turn, move the paddle so as to eject the droplet from the nozzle aperture. In order for the paddle to move properly, so as to eject the droplet, the actuating arm is required to bend upwardly and generally pivot around the fixed end of the arm. Bending of the arm is caused by the application of an electrical current to the arm which causes an elongation of part of the arm relative to another part of the arm. To ensure that the actuating arm bends properly it is necessary to control bending modes of the arm which may result in improper movement of the paddle which may effect the ejection of a droplet from the nozzle chamber. For example, the elongation of one part of the arm relative to the other can cause the arm, rather than to bend upwardly as required, to curl up at the sides forming a general dish shaped configuration, or bend into a sinusoidal configuration or other curved configuration. These bending modes may result in improper movement of the paddle which, as noted above, may effect the manner in which a droplet is ejected from the nozzle chamber.

SUMMARY OF THE INVENTION

A first aspect of the invention provides a thermal bend actuator for a micro electro-mechanical device comprising:

- a first actuator portion,
- a second actuator portion spaced from the first actuator portion, the second actuator portion being conductively heatable to cause bending of the thermal bend actuator,
- a first connecting member interconnecting the first and second portions,
- a second connecting member interconnecting the first and second portions, and
- a torsion member coupled to and interconnecting the first and second connecting members.

Thus, according to this aspect of the invention, the provision of the connecting portions which interconnect the actuator portions and the torsion member which interconnects the connecting portions, reduce the bending modes which are likely to occur upon thermal heating of the thermal bend actuator thereby forcing the actuator to bend according to the desired mode to ensure proper movement of the thermal bend actuator.

The invention may also be said to reside in a micro electro-mechanical device comprising:

- a fluid chamber for containing a fluid,
- an outlet in the chamber for allowing exit of fluid from the chamber,
- a thermal bend actuator for dispensing fluid from the chamber through the outlet aperture, the thermal bend actuator having
  - a first actuator portion,
  - a second actuator portion spaced from the first actuator portion and being conductively heatable to cause bending of the thermal bend actuator,
  - a first connecting member interconnecting the first and second portions,
  - a second connecting member interconnecting the first and second portions, and
  - a torsion member coupled to and interconnecting the first and second connecting members.

PREFERRED FEATURES OF THE INVENTION

Preferably each actuator portion has at least two spaced apart fingers, said first connecting member interconnecting first fingers of the first and second actuator portions, and the second connecting member interconnecting second fingers of the first and second actuator portions.

Preferably each finger is provided with a tab and the respective connecting member is coupled to the tab of each finger.

Preferably each finger has a first edge and a second edge and a plurality of tabs are provided on the first edge and second edge of each finger, and the connecting members extend between a respective one of the tabs on the fingers of the first actuator portion and a respective one of the tabs on the fingers of the second actuator portion.

Preferably the connecting members extend through the tabs of one of the actuator portions and have ends which are spaced from the said one of the actuator portions, and a said torsion member interconnects the ends of respective pairs of the connecting members.

Preferably the connecting members comprise connecting rods.

Preferably the torsion members comprise torsion bars.

Preferably the thermal actuator includes a paddle located in the chamber and moveable upon bending of the thermal actuator to eject a droplet of liquid from the chamber through the nozzle aperture.

Preferably the chamber has an upper wall and the torsion member is formed by deposition simultaneously with the upper wall of the chamber.

Preferably the torsion members are formed by deposition by first forming an opening in the tabs provided on one of the actuator portions and depositing material so that the material is deposited through the openings and onto the tabs associated with the other of the first or second actuator portions so as to interconnect the actuator portions, the material being deposited to form the connection members so that the connection members have free ends substantially level with the upper wall of the chamber.

Preferably the connecting members are provided intermediate ends of the thermal bend actuator.

BRIEF DESCRIPTION OF THE DRAWINGS

A preferred embodiment of the invention will be described, by way of example, with reference to the accompanying drawings in which;

FIG. 6 is a perspective view of a thermal bend actuator according to the preferred embodiment.

DESCRIPTION OF THE PREFERRED EMBODIMENTS

Figure 1:
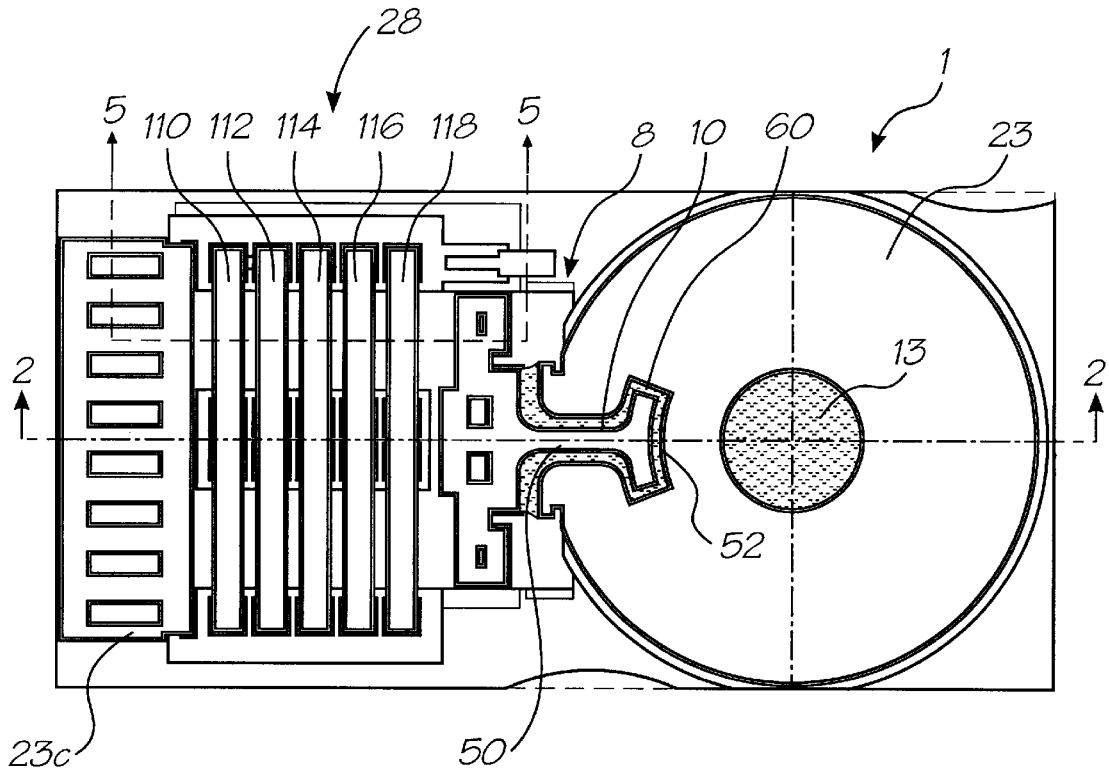
FIG. 1 is a plan view of one embodiment of the invention in an ink jet nozzle for a printer.

As illustrated with approximately 3000× magnification in FIG. 1, and other relevant drawing Figures, a single ink jet nozzle device 1 is shown as a portion of a chip which is fabricated by integrating MEMS and CMOS technologies. The complete nozzle device includes a support structure having a silicon substrate 20, a metal oxide semiconductor layer 21, a passivation layer 22, and a non-corrosive dielectric coating/chamber defining layer 29. Reference may be made to the above identified International Patent Application No. PCT/AU00/001338 for disclosure of the fabrication of the nozzle device. Operation of the device is also more fully disclosed in co-pending application entitled "Movement Sensor In A Micro Electro-mechanical Device" (MJ12) by the same applicant. The contents of these two applications are incorporated into this specification by this reference.

The nozzle device incorporates an ink chamber 24 which is connected to a source (not shown) of ink. The layer 29 forms, amongst other components as will be described hereinafter, a chamber wall 23 which has a nozzle aperture 13 for the ejection of a droplet from ink 25 contained within the chamber 24. As best shown in FIG. 1 the wall 23 is generally cylindrical in configuration with the aperture 13 being provided substantially in the middle of the cylindrical wall 23. The wall 23 has a part circular concave edge portion which forms part of the periphery of the wall 23.

Figure 3:
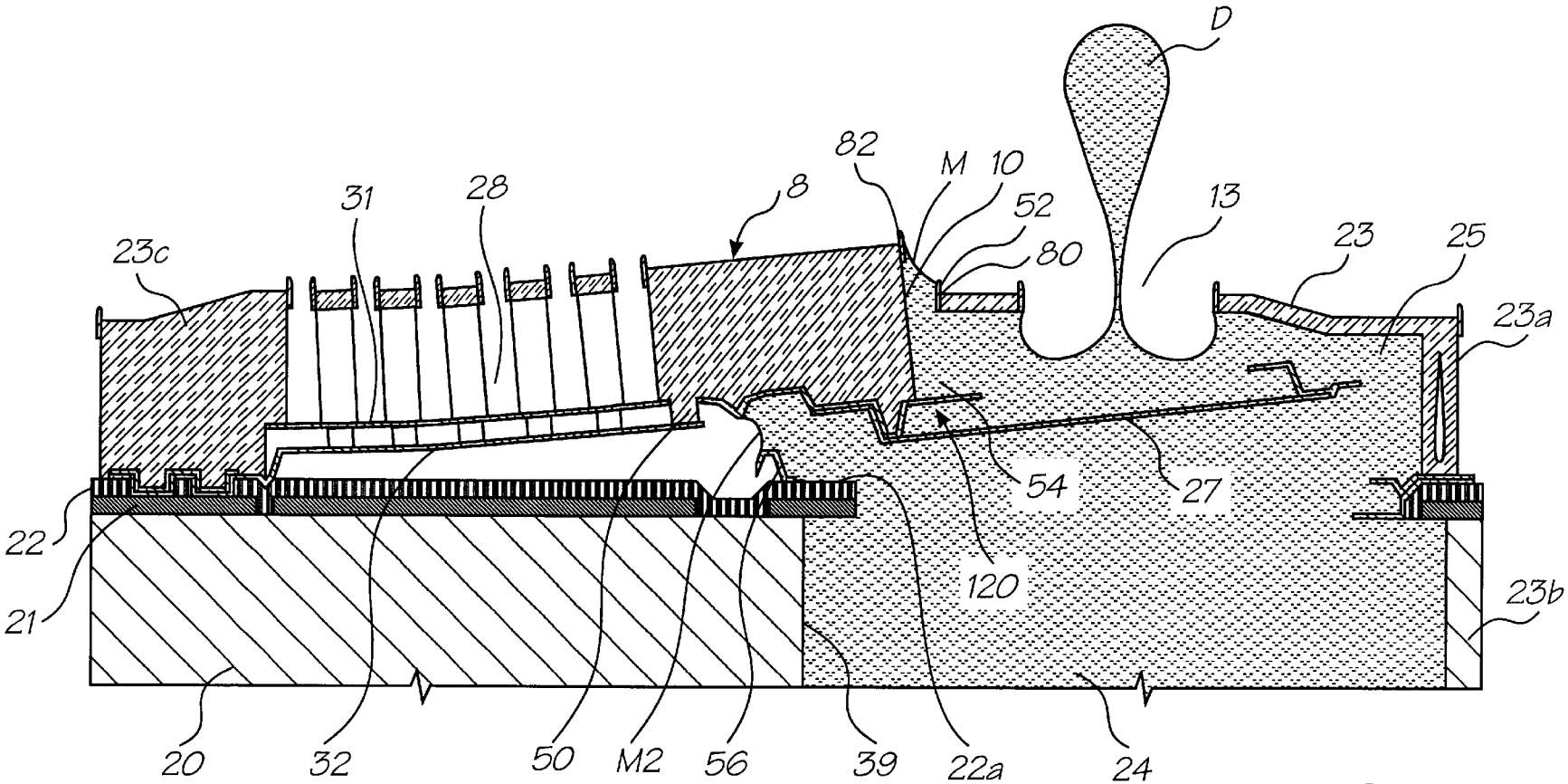
FIG. 3 is a cross-sectional view similar to FIG. 2 showing more detail and with the device in an extreme actuated position showing a drop being ejected from the nozzle.

As best seen in FIG. 3, the chamber 24 is also defined by a peripheral side wall 23*a*, a lower side wall 23*b*, a base wall (not shown), and by an edge portion 39 of substrate 20. An actuating arm 28 (shown schematically in FIG. 3 and in detail in FIGS. 4–6) is formed on layer 22 and support portion 23*c* is formed at one end of the actuating arm 28.

The actuating arm 28 is deposited during fabrication of the device and is pivotable with respect to the substrate 20 and support 23*c*. The actuating arm 28 comprises upper and lower arm portions 31 and 32. Lower portion 32 of the arm 28 is an electrical contact with the CMOS layer 21 for the supply of electrical current to the portion 32 to cause movement of the arm 28, by thermal bending, from the position shown in FIG. 2 to the position shown in FIG. 3 so as to eject droplet D through aperture 13 for deposition on a sheet (not shown). The layer 22 therefore includes the power supply circuitry for supplying current to the portion 32 together with other circuitry for operating the nozzle shown in the drawings as described in the aforesaid co-pending applications.

A block 8 is mounted on the actuator arm 28. The actuator 28 carries a paddle 27 which is arranged within the chamber 24 and which is moveable with the actuator as shown in FIGS. 1 and 3 to eject the droplet D.

The peripheral wall 23*a*, chamber wall 23, block 8 and support portion 23*c* are all formed by deposition of material which forms the layer 29 and by etching sacrificial material to define the chamber 24, nozzle aperture 13, the discrete block 8 and the space between the block 8 and the support portion 23*c*. The lower wall portion 23*b* is also formed during deposition with the substrate 20.

The block 8 includes a generally T-shaped portion 50 (when viewed in plan) which has a peripheral wall 10. The upper wall 23 of the chamber 24 has a generally T-shaped slot 60, defined by edge portion 52 of the wall 23, which receives the T-shaped portion 50 of the block 8. The actuator 28 carries a paddle 27 which is arranged within the chamber 24 and which is moveable with the actuator as shown in FIGS. 1 and 3 to eject the droplet D.

Figure 2:
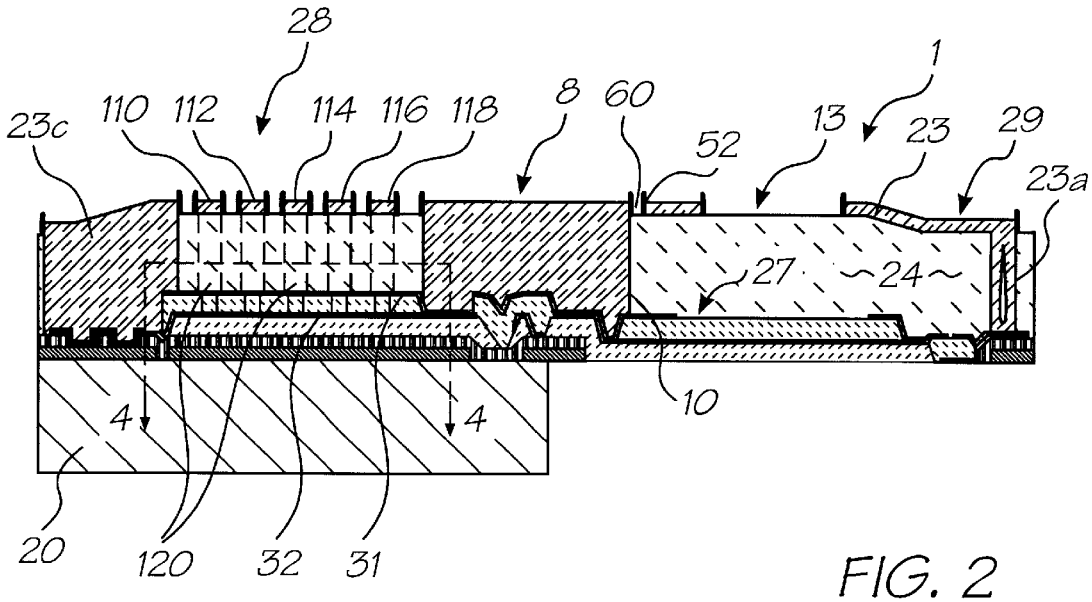
FIG. 2 is a cross-sectional view along the line 2—2 of FIG. 1.

The space between end edge 22*a* of layer 22 and edge portion 50 of the wall 23 defines an actuator aperture 54 which is substantially entirely closed by T-shaped portion 50 of the block 8 when the actuator 28 is in a rest or quiescent state as shown in FIGS. 1 and 2. In the quiescent position shown in FIGS. 1 and 2, the wall 10 of the portion 50 is separated from the edge 52 by a distance of less than one micron so as to define a fine slot between the edge 52 and the wall 10.

As the actuator arm 28 moves up and down to eject droplet D from the chamber 15 24, the block 8 and wall 10 move up and down relative to edge 52 of slot 60 of the wall 23 whilst maintaining a closely spaced apart relationship with the edge 52 of the wall 23. A meniscus M is formed between the wall 10 and the edge 52 as the wall 10 moves up and down relative to the edge 57 in view of the close proximity of the wall 10 to the edge 52. The maintenance of the meniscus M, forms a seal between edge 52 and wall 10, and therefore reduces opportunities for ink leakage and wicking from chamber 24. A meniscus M2 is also formed between support flange 56 formed on the layer 22 and portion 58 of the actuator 28 on which block 8 is formed. When in the quiescent position the portion 58 rests on the flange 56. The formation of the meniscus M2 also reduces opportunities for ink leakage and wicking during movement of the actuating arm 28 and the paddle 27. A meniscus (not shown) is also formed between the sides (not shown) of actuator aperture 54 and the edges (not shown) of wall 23*a* which define the aperture 54.

As shown in FIG. 3, the edge portion 10 may carry a lip 80 and the wall 9 may also carry a lip 82 to further reduce the likelihood of wicking of ink from the chamber 24 onto the block 8 or upper surface of the wall 23. The lip 80 may extend completely about the periphery of the wall 23 and similar lips may also be provided on the aperture 13.

Figure 4:
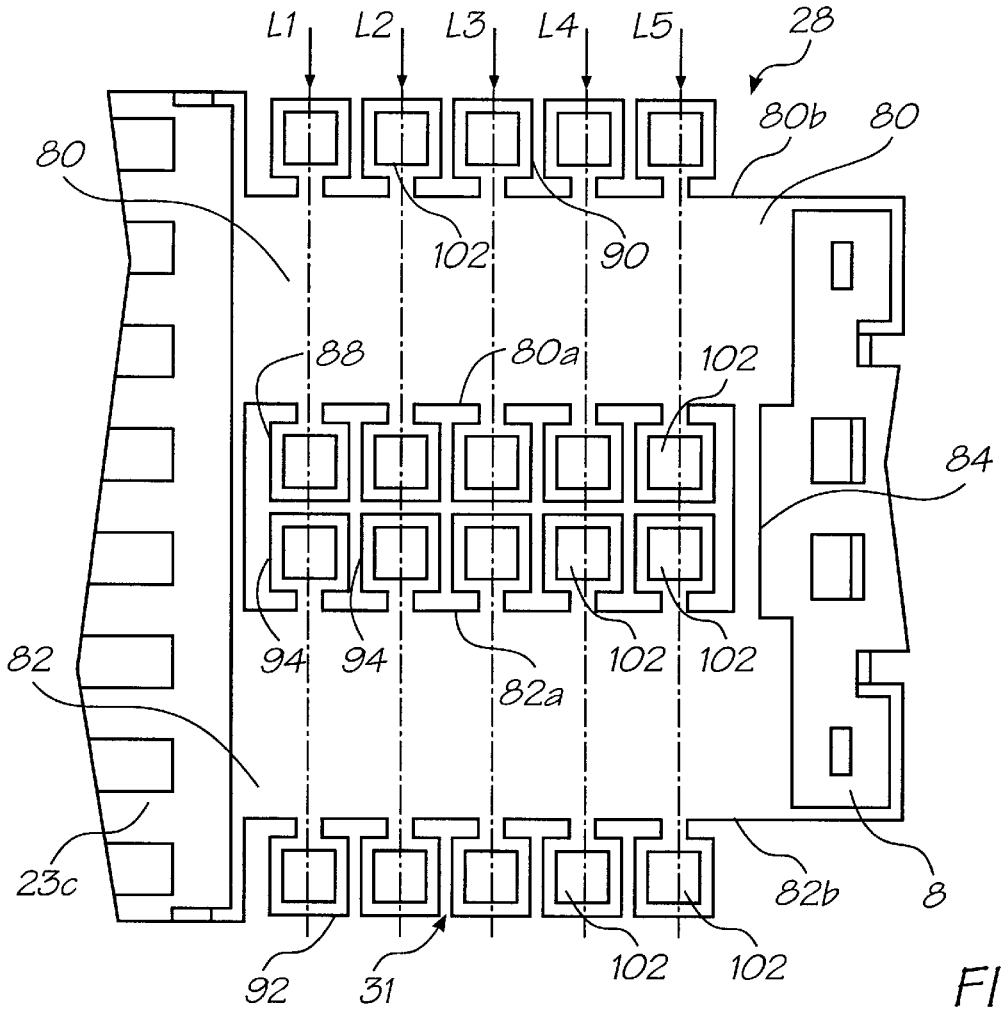
FIG. 4 is a view along the line 4—4 of FIG. 2.
Figure 5:
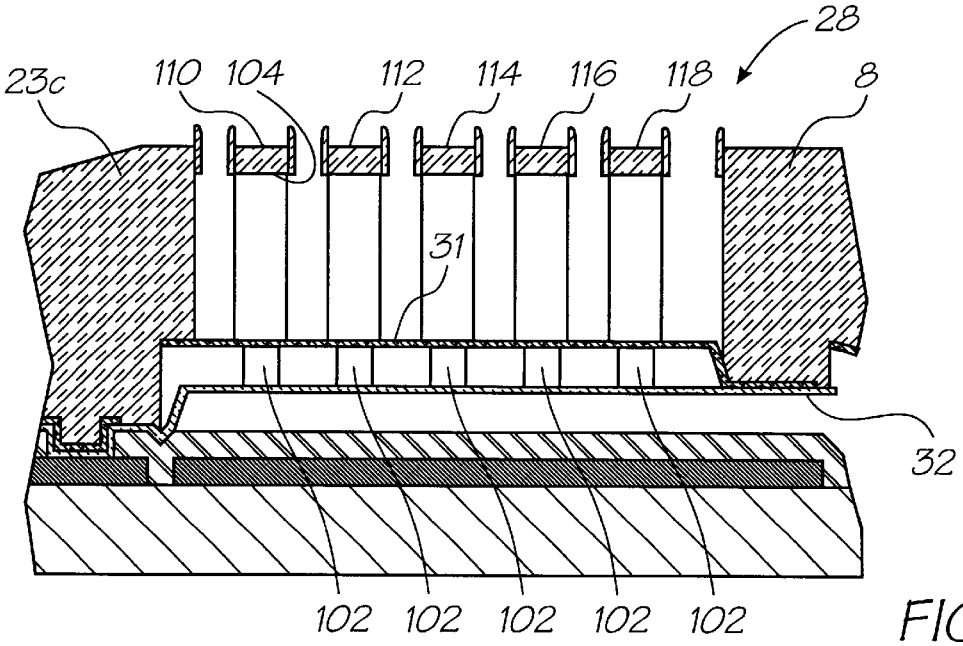
FIG. 5 is a view along the line 5—5 of FIG. 1.

With reference to FIGS. 4 to 6, the thermal bend actuator 28 is shown in detail. In FIG. 6 the block 8 and the support portion 23*c* are not shown for ease of illustration and to show as much detail as possible in FIG. 6 of the actuator arm 28.

The actuator arm includes the lower arm 32 and the upper arm 31 previously described. As best shown in FIG. 4, the lower arm 32 and the upper arm 31 both comprise a first finger 80 and a second finger 82 which are joined by a base section 84. The ends of the fingers 80 and 82 remote from the base section 84 are secured in support structure 23*c* so that the arm 28 can pivot relative to the support structure 23*c* as shown in FIG. 3. The fingers 80 and 82 have side edges 80*a* and 80*b* and 82*a* and 82*b* respectively. The side edges 80*a*, 80*b*, 82*a* and 82*b* have integral tabs or staples 88, 90, 92 and 94 respectively. As shown in FIG. 4, five such tabs are provided on each of the side edges 80*a*, 80*b*, 82*a* and 82*b*.

The tabs on the arm 31 are formed integral with the remainder of the arm 31 when the arm 31 is deposited. The lower arm 32 is identical to the arm 31 as described above and is arranged below the upper arm 31 as clearly shown in FIGS. 2, 3, 5 and 6.

The tabs 88, 90, 92 and 94 in upper arm 31 are provided with circular holes 100. The holes 100 are formed by masking and depositing sacrificial material within the tabs 88–94 and then etching away the sacrificial material to leave holes 100 passing through the tabs 88 to 92. Rods 102 are deposited so as to extend from tabs 88–92 (not shown) on lower arm 32 through the holes 100 in tabs 88–92 of the upper arm 31. The rods 102 have a free end 104 which is substantially at the same level as the upper wall 23 of the chamber 24 when the arm 28 is in its quiescent position shown in FIGS. 1 and 2. Thus, the tab 92 on the arm 32 is interconnected with the tab 92 on the arm 31 which is immediately above the tab on the arm 32. Each of the tabs 88, 90, 92 and 94 of the respective arms 31 and 32 are connected by rods 102 in the same manner.

As will be apparent from a consideration of FIGS. 4 to 6, five sets of rods 102 are therefore provided with each set containing four rods 102 which are in alignment as shown by lines labelled L1 to L5 in FIG. 4. The posts 102 in line L1 are interconnected at their free ends 104 by a torsion rod 110. The posts in line L2 are interconnected by a torsion rod 112. The posts in line 13 are interconnected by a torsion rod 114. The posts in line L4 are interconnected by a torsion rod 116 and the posts in line L5 are interconnected by a torsion rod 118. The torsion rods 110–118 may be deposited at the same time as the layer 29 from which the upper wall 23, block 8 and support structure 23*c* is formed. The torsion bars 110 to 118 therefore interconnect the sides of the fingers 82 and 80 and prevent the side edges from curling or cusping upwardly so that the actuator arms would form a dish shape or valley type shape upon application of current to the arm 32. Hence the torsion bars 110 to 118 reduce the opportunity for any cusping of the thermal bend actuator during operation and reduce the number of bending modes which are possible upon heating of the actuator arm 32. This tends to force the arm to bend only in the manner shown in FIG. 3 so as the paddle is moved in the proper manner to properly eject a droplet D from the nozzle aperture 13.

The provision of five posts on each edge of the fingers 80*a* to 82*b* also ensures that the likelihood of the arms bending into a sinusoidal or wave like shape is prevented. The torsion rods 110 to 118 therefore tie the two edges of the arms 31 and 32 together and in particular the side edges of the fingers 88 to 94 together thereby preventing the cusping or bowing of the actuator arm and the plural number of posts 102 arranged along the edges 80*a* to 80*b* of intermediate the ends of the fingers 80 and 82 further reduces the possible bending modes by reducing the likelihood of the arms bending into a sinusoidal or wave like shape.

I claim:

1. A thermal bend actuator for a micro electro-mechanical device comprising:

a first actuator portion, a second actuator portion spaced from the first actuator portion and being conductively heatable to cause bending of the thermal bend actuator, a first connecting member interconnecting the first and second portions, a second connecting member interconnecting the first and second portions, and a torsion member coupled to and interconnecting the first and second connecting members.

2. The actuator of claim 1 wherein each actuator portion has at least two spaced apart fingers, said first connecting member interconnecting first fingers of the first and second actuator portions, and the second connecting member interconnecting second fingers of the first and second actuator portions.

3. The actuator of claim 1 wherein the connecting members comprise connecting rods.

4. The actuator of claim 1 wherein the torsion members comprise torsion bars.

5. The actuator of claim 2 wherein each finger is provided with a tab and the respective connecting member is coupled to the tab of each finger.

6. The actuator of claim 5 wherein each finger has a first edge and a second edge, and a plurality of tabs are provided on the first edge and second edge of each finger, and the connecting members extend between a respective one of the tabs on the fingers of the first actuator portion and a respective one of the tabs on the fingers of the second actuator portion.

7. The actuator of claim 6 wherein the connecting members extend through the tabs of one of the actuator portions and have ends which are spaced from the said one of the actuator portions, and a said torsion member interconnecting the ends of respective pairs of the connecting members.

8. A micro electro-mechanical device comprising:

a fluid chamber for containing a fluid, an outlet in the chamber for allowing exit of fluid from the chamber, a thermal bend actuator for dispensing fluid from the chamber through the outlet aperture, the thermal bend actuator having a first actuator portion, a second actuator portion spaced from the first actuator portion and being conductively heatable to cause bending of the thermal bend actuator, a first connecting member interconnecting the first and second portions, a second connecting member interconnecting the first and second portions, and a torsion member coupled to and interconnecting the first and second connecting members.

9. The device of claim 8 wherein each actuator portion has at least two spaced apart fingers, said first connecting member interconnecting first fingers of the first and second actuator portions, and the second connecting member interconnecting second fingers of the; first and second actuator portions.

10. The device of claim 8 wherein the connecting members comprise connecting rods.

11. The device of claim 8 wherein the torsion members comprise torsion bars.

12. The device of claim 8 wherein the thermal actuator includes a paddle located in the chamber and moveable upon bending of the thermal actuator to eject a droplet of liquid from the chamber through the nozzle aperture.

13. The device of claim 8 wherein the chamber has an upper wall and the torsion member is formed by deposition simultaneously with the upper wall of the chamber.

14. The device of claim 8 wherein the connecting members are provided intermediate ends of the thermal bend actuator.

15. The device of claim 9 wherein each finger is provided with a tab and the respective connecting member is coupled to the tab of each finger.

16. The device of claim 15 wherein each finger has a first edge and a second edge, and a plurality of tabs are provided on the first edge and second edge of each finger, and the connecting members extend between a respective one of the tabs on the fingers of the first actuator portion and a respective one of the tabs on the fingers of the second actuator portion.

17. The device of claim 16 wherein the connecting members extend through the tabs of one of the actuator portions and have ends which are spaced from the said one of the actuator portions, and a said torsion member interconnecting the ends of respective pairs of the connecting members.

18. The device of claim 17 wherein the connecting members are formed by deposition by first forming an opening in the tabs provided on one of the actuator portions and depositing material so that the material is deposited through the opening and onto the tabs associated with the other of the first or second actuator portions so as to interconnect the actuator portions, the material being deposited to form the connection members so that the connection members have a free end substantially level with the upper wall of the chamber.

* * * * *